United States Patent [19]

Jones

[11] 4,191,014

[45] Mar. 4, 1980

[54] POWER MODE AIR SWITCHING DIVERTER VALVE

[75] Inventor: John E. Jones, Rochester, N.Y.

[73] Assignee: General Motors Corporation, Detroit, Mich.

[21] Appl. No.: 851,180

[22] Filed: Nov. 14, 1977

[51] Int. Cl.[2] ..... F01N 3/10

[52] U.S. Cl. ..... 60/290; 60/306

[58] Field of Search ..... 60/290, 307, 306

[56] References Cited

U.S. PATENT DOCUMENTS

| | | | |
|---|---|---|---|
| 3,835,646 | 9/1974 | Ranft | 60/290 |
| 3,955,364 | 5/1976 | Lewis | 60/290 |
| 3,975,905 | 8/1976 | Shimo | 60/290 |
| 4,050,249 | 9/1977 | Collins | 60/290 |
| 4,070,830 | 1/1978 | Beiswenger | 60/290 |

*Primary Examiner*—Douglas Hart

*Attorney, Agent, or Firm*—Arthur N. Krein

[57] ABSTRACT

In a system for delivering secondary air from an air pump selectively, as a function of engine operation, to either the exhaust manifold at a location closely adjacent to the exhaust ports of the engine, or either to a converter in the exhaust system downstream of the exhaust manifold or to the atmosphere, as preselected, an integral air switching diverter valve assembly having an inlet connected to the air pump, a primary outlet for discharge of air to the exhaust manifold and a secondary outlet, for delivery of air either to the converter or to the atmosphere, as preselected, a valve being mounted in the assembly for movement between a first position to which it is normally biased to allow secondary air flow and through the secondary outlet while blocking secondary air flow through the first outlet to the exhaust manifold and a second position to allow secondary air flow to the exhaust manifold while blocking air flow out through the second outlet, the assembly including a differential pressure operated switching diaphragm assembly used to effect movement of the valve between the port and converter modes, an engine manifold vacuum actuated divert timing assembly operative to control operation of the switching diaphragm assembly, the valve further including a pressure relief outlet which is operative for pressure relief of excess secondary air above a predetermined pressure to the atmosphere.

1 Claim, 3 Drawing Figures

POWER MODE AIR SWITCHING DIVERTER VALVE

Figure 1:
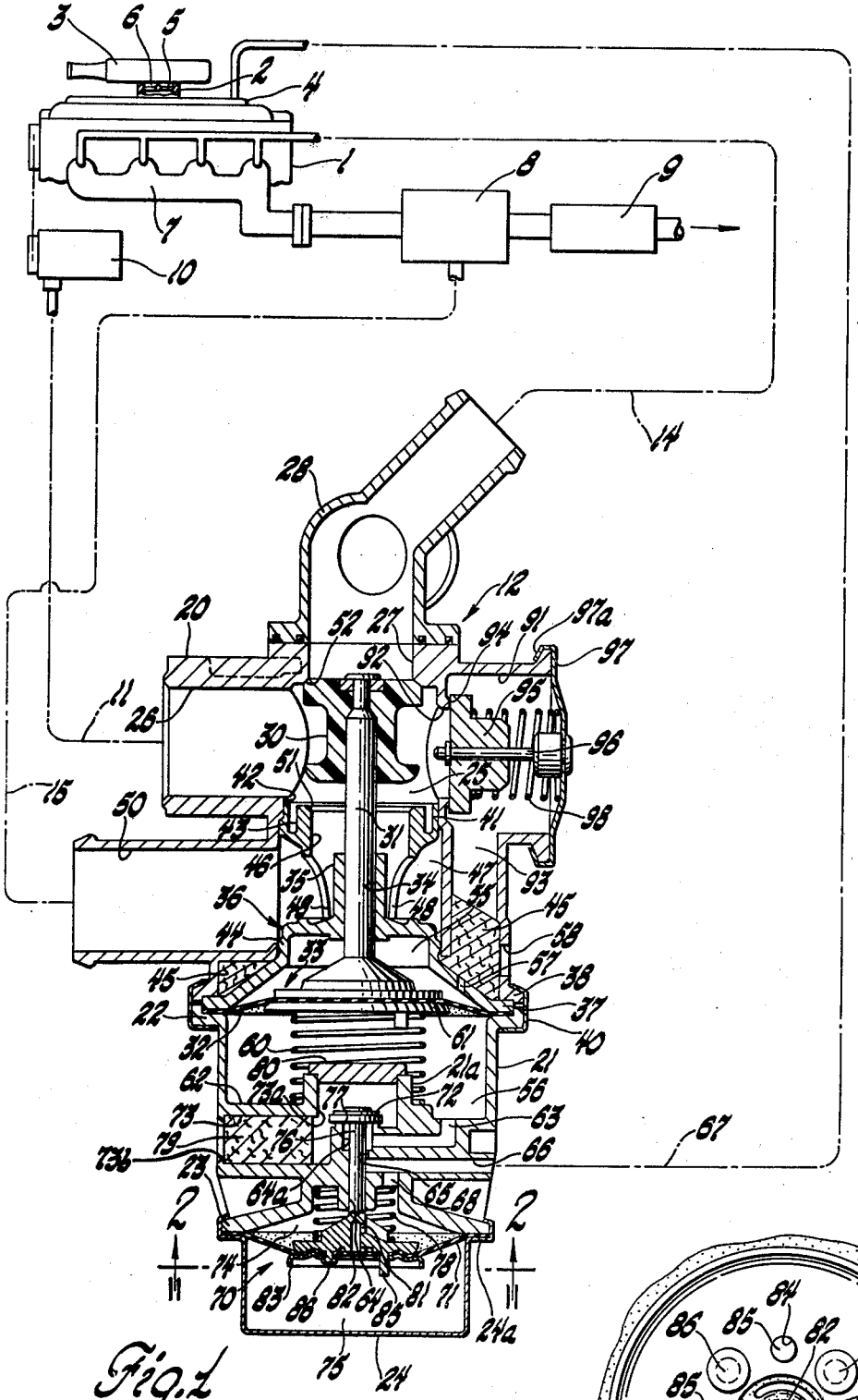

This invention relates to an air flow control valve for use in a system which delivers air from an air pump to the exhaust system of a vehicle mounted internal combustion engine and, in particular, to an air diverter valve for selectively switching the flow of secondary air out either of two outlets from the valve as a function of engine operation in a predetermined manner.

It has been found in emission control systems for internal combustion engines of the type which includes an air injection device for introducing secondary air into the exhaust system closely adjacent to the exhaust ports of an engine that, for efficient and trouble free operation, it is necessary that the delivery of secondary air to the exhaust ports be suitably controlled by an air control or diverter valve structure so that air is not continuously delivered to the exhaust system adjacent the exhaust ports during all modes of engine operation, but instead such secondary air should only be delivered to the exhaust ports during certain modes of engine operation, and, at other times the secondary air is diverted.

Suitable air flow control valves to provide the above described function are disclosed, for example, in United States patent application Ser. No. 735,047 entitled "Integral Air Switching Diverter Valve" filed Oct. 22, 1976 in the name of David W. Beiswenger and assigned to a common assignee, now U.S. Pat. No. 4,070,830. Although the air flow control valves disclosed in the above identified application are suitable for use in certain exhaust emission control systems for specific engine classes, they may not be most advantageous for use in certain other systems or with smaller size engines, such as four cylinder engines due to the fact that, for example, in one embodiment of that valve the vacuum signal applied thereto is, in effect, constantly bled to atmosphere under certain engine operating conditions.

It is therefore a primary object of this invention to provide an air switching diverter valve for use in an exhaust emission control system in which vacuum bleeds are intolerable, such as for example for use with such a system associated with a small displacement four cylinder engine and/or those applications which use a vacuum signal common to other critically calibrated devices associated with an engine.

Another object of this invention is to provide an air control valve for use in an exhaust emission control system for an internal combustion engine that is operative during a power mode of the engine to direct secondary air to the exhaust manifold of the engine to reduce exhaust emissions.

These and other objects of the invention are obtained in an air switching diverter valve for use in a system for delivering secondary air to the exhaust system of an internal combustion engine, wherein the air switching diverter valve includes a housing having an inlet for receiving secondary air and that opens into a central chamber within the housing, a primary outlet and a secondary outlet in the housing with one end of each extending from diametrically opposite sides of the central chamber, a valve movably positioned in the central chamber for the selective control of discharge through either the primary outlet or the secondary outlet, a switching diaphragm assembly has its diaphragm operatively connected to the valve and the diaphragm is positioned in the housing to form with a portion thereof a chamber open to the atmosphere on one side of the diaphragm and an actuating or metering chamber on the opposite side of the diaphragm, the actuating or metering chamber being connected through an orifice passage to a source of engine vacuum and being connectable in fluid communication, as controlled by a control valve, to the atmosphere, the control valve being operatively connected to the diaphragm of a divert timing assembly positioned in the housing with the diaphragm of the divert timing assembly forming with a portion of the housing a vacuum chamber on one side of the diaphragm that is connected to the source of engine vacuum and a timing chamber on the opposite side of the diaphragm, a pressure relief valve controlled outlet being positioned in the housing in flow communication with the central chamber whereby to permit discharge of air above a predetermined pressure from the air control valve assembly.

Figure 2:
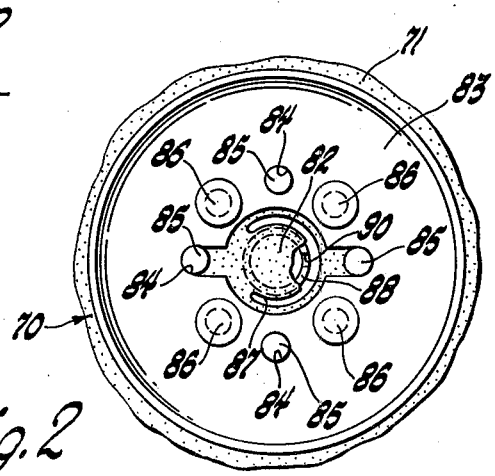
Figure 3:
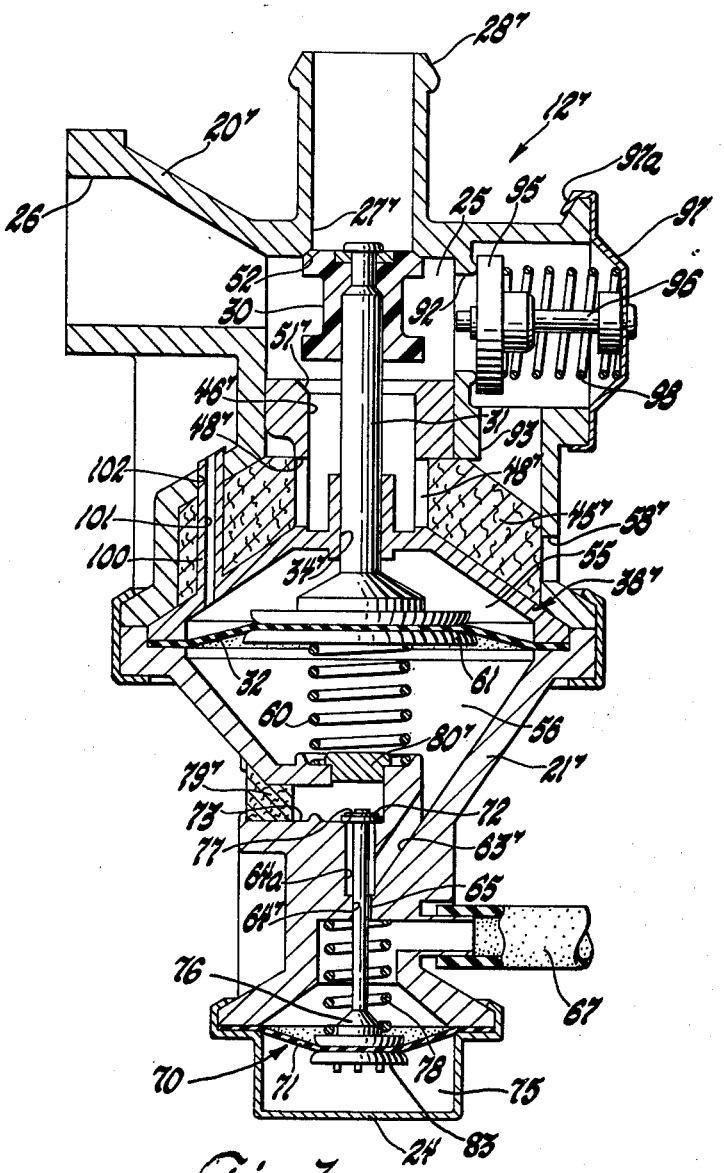

For a better understanding of the invention, as well as other objects and further features thereof, reference is had to the following detailed description of the invention to be read in connection with the accompanying drawings, wherein:

FIG. 1 is a schematic view of an internal combustion engine having an air pump for delivering secondary air to the exhaust system for the engine and having incorporated therein a power mode air switching diverter valve in accordance with a preferred embodiment of the invention, this valve assembly being shown in enlarged sectional elevational view disposed between the air pump and the exhaust system, with the elements shown in their respective positions for that with no vacuum or air flow;

FIG. 2 is a view taken along line 2—2 of FIG. 1, further enlarged, to show the divert timing valve arrangement, and, FIG. 3 is a sectional elevational view of an alternate embodiment of a power mode air switching diverter valve in accordance with the invention.

Referring now to FIG. 1, an internal combustion engine 1 is provided, for example, with a carburetor 2 and an air cleaner 3 mounted thereon to supply induction fluid to the intake manifold 4 of the engine, primary air flow through the carburetor to the engine being controlled by a throttle valve 5 pivotal within the induction passage 6 extending through the carburetor. An exhaust manifold 7 receives the exhaust gases discharged through the exhaust ports (not shown) from the cylinders (not shown) of the engine and defines a flow path for the combustible exhaust gases discharged therefrom. Each exhaust manifold 7, in the construction illustrated is suitably connected to a catalytic converter 8 and a muffler 9.

An air pump, such as an engine driven air pump 10, delivers clean secondary air via a conduit 11 to an integral air switching diverter valve, generally designated 12, in accordance with a preferred embodiment of the invention, which is operative in a manner to be described to effect delivery of secondary air either through a conduit 14 to the exhaust manifold 7 for discharge closely adjacent to the exhaust ports (not shown) of the engine on the downstream side thereof or, via a conduit 15 to the converter 8.

The integral air switching diverter valve assembly 12, in the construction shown in FIG. 1, includes a multiple piece housing having as major elements thereof an upper body 20, an intermediate body 21 provided with upper and lower flanges 22 and 23, respectively, and a lower cup-shaped cover 24 suitably secured together in a manner to be described. The upper body 20 is formed with a central stepped opening extending upward from the lower portion thereof, to provide a central or valve chamber 25 at the upper end thereof and with a lateral air inlet passage 26 from a side thereof which is connected at one end to conduit 11 and has its other end opening into the central chamber 25. A primary discharge or outlet passage 27 in the upper body 20 has one end thereof opening into the central chamber 25 and has its other end connected by conduit coupling 28 and conduit 14 to the exhaust manifold 7.

A valve member 30 is movably positioned in the central chamber 25 and is secured to the upper end of a valve stem 31, the lower end of the valve stem being suitably secured to the diaphragm 32 of a switching diaphragm assembly, generally designated 33. The valve stem 31 is sealingly guided for reciprocal movement in the valve guide bore 34 in the central guide portion 35 of an insert member 36 which is secured about its lower rim 37 together with the outer peripheral edge of diaphragm 32 between the lower rim 38 of upper body 20 and the upper flange 22 of intermediate body 21, these elements being secured together as by a band clamp 40.

The upper rim 41 of insert member 36 is pressed into the bore portion 42 of upper body 20, a deep groove 43 in the upper rim 41 facilitating the press fit. In addition, the intermediate rim 44 of the insert member 36 is in sealing engagement with the annular inner wall of the bore portion 42 of the upper body 20 whereby to define an annular chamber, preferably filled with noise suppressor or silencing material 45, between the upper surface of the lower portion of insert member 36 and the lower portion of the upper body 20.

Insert member 36 has a cylindrical recess surrounding the guide portion 35 to provide an air divert passage 46, and the intermediate portion of the insert member between the upper rim 41 and the intermediate rim 44 forms with the interior of the upper body an annular chamber 47 which is in communication with the divert passage 46 by means of openings 48 through the annular wall of the insert member 36. A second lateral or outlet passage 50 is provided through the upper body 20 which opens at one end to the annular air chamber 47 and is connected at its opposite end by the conduit 15 to the converter 8. The outlet 50, air chamber 47, openings 48 and divert passage 46 form, in effect, a secondary discharge or outlet passage of the valve assembly.

The upper periphery of the insert 36 surrounding recess 46 defines a lower valve seat 51 which is engageable by the valve member 30 and which is positioned in axial alignment, relative to the axis of valve stem 31, with an upper valve seat 52 surrounding the primary outlet passage 27.

The switching diaphragm 32 forms with the lower end of the insert member 36 in housing 20 an upper or atmospheric chamber 55 and with the intermediate housing 21 a lower or actuating or metering chamber 56. The upper chamber 55 is referred to as an atmospheric chamber because it is continually in communication with the atmosphere via one or more apertures 57 in the lower portion of insert member 36, the annular chamber filled with silencing material 45 and one or more relief ports 58 in the outer side wall of the upper body 20.

The lower actuating or metering chamber 56 has a coiled, metering spring 60 positioned therein, one end of the spring abutting against the diaphragm retainer 61 suitably fixed to the lower end of the valve stem 31 with the diaphragm sandwiched therebetween and, the opposite end of the spring 61 abutting against the intermediate web wall 62 of intermediate body 21 whereby the valve member 30 is normally biased against the valve seat 52 to thereby block flow of air from chamber 25 out through the primary discharge outlet passage 27 to the exhaust manifold 7 while permitting air to be discharged out through the secondary discharge outlet tube 50 to the converter 8. The actuating or metering chamber 56 may be referred to as a secondary vacuum chamber since, in a manner to be described, it is in controlled flow communication with a source of engine vacuum. In the construction illustrated in FIG. 1, an L-shaped vacuum passage 63, provided in intermediate body 21, opens at one end into this chamber 56 and opens at its other end into the enlarged bore end 64*a* of a stepped bore 64 through the lower end of the intermediate body, the enlarged bore end 64*a* being in communication via a suitable metering control orifice 65 in communication with a lateral passage 66 in intermediate body 21 that is connected by a conduit 67 to a source of engine vacuum, such as the intake manifold 4 downstream of throttle valve 5. Lateral passage 66 is also in communication via a side port passage 68 with the vacuum chamber of a divert timing assembly, generally designated 70.

The divert timing assembly 70 includes a diaphragm 71 used to control the movement of a bleed valve 72, to be described, controlling flow of atmospheric air via a bleed passage 73 to the metering chamber 56. As shown, the diaphragm 71 has its outer peripheral edge sandwiched between the lower flange 23 of intermediate body 21 and the upper rim 24*a* of cover 24, these elements being suitably secured together, as by having the upper rim 24*a* spun over flange 23. Diaphragm 71 thus forms with the lower inverted cup portion of intermediate body 21 and with cover 24 a vacuum chamber 74 on the upper side of the diaphragm and a timing chamber 75 on its lower side.

Fixed to and extending upward from the diaphragm 71 is a bleed valve stem 76 that is reciprocably journaled in the stem guide portion of bore 64, the valve stem 76 supporting at its free end the bleed valve 72 for movement relative to an annular valve seat 77 encircling the upper enlarged bore end 64*a*. A coiled spring 78 is positioned in the vacuum chamber 74 with one end of the spring abutting against the lower end surface of intermediate body 21 and its other end abutting against the lower flanged end of the bleed valve stem 76 whereby to normally bias it and therefore the bleed valve 72 to a closed position, the position shown, relative to valve seat 77.

To permit axial movement of bleed valve 72 to an open position relative to valve seat 77 and to facilitate assembly, the bleed passage 73, in the construction illustrated, is formed in part by an enlarged bore portion 73*a* through the upstanding interior boss 21*a* of intermediate body 21 concentric with bore 64, and in part by an intersecting lateral bore 73*b* open at one end to the atmosphere and partly filled with a suitable filter material 79. A non-porous plug 80 is suitably fixed to boss 21*a* to seal chamber 56 from the bore portion 73*a*.

The metering control orifice 65 for example, may be provided, as in the construction illustrated, in part by means of an axial extending groove formed in the wall of the reduced diameter portion of guide bore 64 between lateral passage 66 and the enlarged bore end 64*a* or it may be provided by suitable predetermined clearance between this portion of bore 64 and the outer peripheral surface of bleed valve stem 76.

Control valve stem 76 has a passage 81 therein used to connect vacuum chamber 74 with the timing chamber 75, with a flat type check valve 82 being disposed to regulate flow through the passage 81 into timing chamber 75. The details of the check valve 82 are shown most clearly in FIG. 2. A diaphragm retainer in the form of a washer 83 is positioned under diaphragm 71 and it is provided with a plurality of apertures 84 which receive the alignment pins 85 formed on the lower portion of the valve stem 76. At least four of these alignment pins 85 are riveted as at 86 to retain the washer 83 to the control valve stem with the diaphragm 71 sandwiched therebetween.

The outer rim of the check valve 82 is supported by the inner rim of the washer 83. A flapper valve in the form of a central flap 87 of the check valve 82 overlies an annular valve seat 88 formed in the base of the control valve stem 76. A timing orifice in the form of a notch 90 is coined in the seat 88. During the period when manifold vacuum in vacuum chamber 74 is increasing, flow from timing chamber 76 through the passage 81 to chamber 74 is restricted to pass only through the notch 90. Thus, the volume of the timing chamber 76 and the size of the notch 90 determine the time required for the pressure in timing chamber 76 to be reduced to the point where spring 78 will lower diaphragm 71 and the bleed valve stem 76 with the bleed valve 72 to the closed position, shown in FIG. 1, relative to valve seat 77. During a period of increasing pressure in chamber 74, the central flap 87 will be pushed downwardly to allow unrestricted flow from the chamber 74 through passage 81 to timing chamber 75 and thus permit immediate return of the diaphragm 71 and the bleed valve stem 76 with the bleed valve 72 to the position shown. In this position communication between the metering chamber 56 and the atmosphere via bleed passage 73 is blocked.

Pressure relief from the valve assembly 12 is effected by a pressure relief assembly incorporated into this valve structure. As shown, the upper body 20 has a pressure relief passage 91 extending from a lateral opening 92 opening into the side of the central chamber 25 diametrically opposite inlet passage 26. The pressure relief passage 91 includes an axially extending channel 93 provided in one side of the upper body 20 to open into the top of the annular chamber having the noise suppressor material 45 therein.

A valve seat 94 is formed about opening 92 and is engaged by a valve member 95 which slides on a shaft 96 suitably fixed at one end to a cover 97 that is secured to the upper body 20 as by a spun over flange portion 97*a* of cover 97.

The pressure relief feature is provided by a calibrated spring 98 which normally biases valve member 95 against the valve seat 94 until the pump discharge pressure in the central chamber 25 rises above a predetermined level. At that level, valve member 95 is moved axially in a direction on the shaft 96 whereby it unseats from the valve seat 94 and a portion of the air flow through inlet 26 into the central chamber 25 is diverted through the channel 93 for discharge to the atmosphere through the radial relief ports 58.

In operation, upon starting of the engine and proceeding to a constant speed and load made of vehicle operation, steady-state levels of manifold vacuum supplied via conduit 67 initially are prevented from opening the valve member 30 relative to valve seat 52 permitting flow out through the primary outlet passage 27 as the divert timing assembly 70 is then operative to effect unseating of bleed valve 72 to place metering chamber 56 in communication with the atmosphere via bleed passage 73 thereby preventing vacuum build-up in metering chamber 56 supplied with a vacuum signal via the metering control orifice 65. Thus secondary air supplied by pump 10 to the air inlet passage 26 is diverted through the divert passage 46 for discharge via outlet passage 50 and conduit 15 to the converter 8.

During this and all other modes of operation the valve member 95 of the pressure relief assembly is operative, in the manner described, to regulate the air pressure in chamber 25 with any excess air being discharged to the atomsphere.

After some designated period of time, usually less than ten seconds, the timing orifice, defined by notch 90, in the divert timing assembly 70 allows equalization of vacuum on both sides of the divert diaphragm 71, and the spring 78 is then operative to close the bleed valve 72 relative to valve seat 77. This allows the vacuum to build in the metering chamber 56 via the metering control orifice 65 and vacuum passage 63 and, provided the vacuum level is high enough to counteract the force of the metering spring 60, the pressure differential pressure acting on diaphragm 32 will move the valve member 30 toward seating engagement against the lower valve seat 51 thereby permitting air flow via primary outlet passage 27 and conduit 14 for discharge into the exhaust manifold 7 next adjacent to the exhaust ports, not shown, of the engine 1. The valve member 30 then remains open relative to upper valve seat 52 and the bleed valve 72 remains closed until manifold vacuum supplied to lateral passage 66 changes by an amount sufficient to effect movement of either the diaphragm 32 of the metering assembly or the diaphragm 71 of the divert timing assembly 70. During engine acceleration, as engine manifold vacuum drops to near atmospheric pressure, the pressure in metering chamber 56 will also drop and that pressure plus the force of metering spring 60 will cause diaphragm 32 to move in a direction to partially or fully (depending on the vacuum level), block air flow out through the primary discharge outlet 27. In addition, the low manifold vacuum level in the vacuum chamber 74 of the divert timing assembly 70 is rapidly equalized across the diaphragm 71 by the dumping action of the flapper valve 87. This allows the divert timing assembly 70 to function properly when going from a brief acceleration mode directly to a deceleration mode of operation without having trapped a high vacuum in the timing chamber 75 which would operate to keep the bleed valve 72 closed thus defeating the divert function of the subject valve.

During a deceleration, engine manifold vacuum increases above the steady-state level. Increasing vacuum in the vacuum chamber 74 will cause the diaphragm 71 of the divert timing assembly 70 to act against the bias of spring 78 and, provided the rate of vacuum change is sufficient to overcome the equalization effect of the timing orifice 90, the differential pressure across the diaphragm 71 overcomes the retarding force of spring 78 thus moving the bleed valve stem 76 in a direction to effect opening of the bleed valve 72 relative to its valve seat 77. This again vents the metering chamber 56 to atmosphere through the bleed passage 73 which allows the metering spring 60 to move the valve member 30 into seating engagement against upper valve seat 52 to block flow out through the primary discharge passage 27 and permits diverting of air flow out via divert passage 46 to outlet passage 50.

An alternate embodiment of an air switching diverter valve, generally designated 12', constructed in accordance with the invention, is shown in FIG. 3, wherein similar parts are designated by similar numerals with the addition of a prime (') after the reference numbers where appropriate. In this alternate embodiment, secondary air, as supplied by an air pump 10, is either directed via the primary outlet passage 27', provided in the upper body 20' of the valve structure, to the exhaust ports, not shown, of the engine via a conduit 14, or diverted to the atmosphere.

To effect this, the insert member 36', in the valve structure of FIG. 3, is provided at its upper end with a divert passage 46' that opens at one end through the annular valve seat 51' into the central chamber 25 in upper body 20' and is in communication at its other end via a plurality of discharge ports or openings 48' in the outer wall of the insert member 36' with the annular cavity containing the noise suppressor material 45' and relief ports 58' with the atmosphere. These latter described elements, in effect, provide the secondary discharge passage means for this valve assembly.

Insert member 36' is also provided with an upstanding side extension 100, having a bore passage 101 therethrough, that projects through an aperture 102 provided for this purpose in a side wall of upper body 20' whereby the atmospheric chamber 55 in one side of diaphragm 32 is in open communication with the atmosphere.

Operation of this alternate embodiment air switching diverter valve 21' is the same as that described for the air switching diverter valve 12 except, of course, for the fact that diverted air flowing into the air divert passage 46' is discharged to the atmosphere as directed by the secondary discharge passage means of this valve assembly.

From the above description of the operation of the air switching diverter valves, it will be apparent that since the metering chamber 56 is only in communication with the atmosphere for a brief period at engine start up and during periods of deceleration, provided the rate of vacuum change is sufficient, by opening of the bleed valve 72 relative to its valve seat 77, there is little bleeding of vacuum, that is loss of vacuum pressure by flow of atmospheric air to the metering chamber. In addition, even when bleed valve 72 is open, the vacuum signal applied to the metering chamber 56 is limited by flow through the metering control orifice 65 which can be appropriately sized, as desired, for a given engine with which the subject valve is to be used.

Although the atmospheric chamber 55, in the construction of the valve assembly shown in FIG. 1, was shown and described as being in communication with the atmosphere via one or more apertures 57 in the lower portion of insert member 36, the annular chamber filled with silencing material 45 and one or more relief ports 58 in the outer side wall of the upper body, it should be realized that, preferably, this atmospheric chamber would be directly placed in communication with the atmosphere via an apertured side extension similar to the upstanding side extension 100, with the bore passage 101 therethrough of the valve structure of FIG. 3. Such a modification would be desired in certain application to permit only atmospheric air pressure to prevail in the atmospheric chamber 55.

What is claimed is:

1. An air switching diverter valve for use with an engine having an induction system with a throttle movable therein and an exhaust emission control system including an exhaust manifold connected to the engine for receiving exhaust gases discharged from the exhaust ports of the engine and, a driven air pump for providing secondary air to the exhaust emission control system, said air switching diverter valve including a housing having a valve chamber therein, an inlet passage opening into said valve chamber and adapted to be connected to the air pump for receiving secondary air, a primary discharge passage in said housing extending from said valve chamber and adapted to be connected to said exhaust manifold, a secondary discharge passage from said valve chamber and a bypass outlet passage extending from said valve chamber for discharging air to the atmosphere, a one-way pressure relief valve means positioned in said bypass outlet passage to control flow from said valve chamber out through said bypass outlet passage, one end of said primary discharge passage and one end of said secondary discharge passage being axially aligned in spaced apart relation to each other, a metering valve means including a metering valve movably supported in said housing, said valve being positioned in said valve chamber for movement between a first position blocking flow from said valve chamber out through said primary discharge passage and a second position blocking flow from said valve chamber out through said secondary discharge passage, actuator means including a diaphragm operatively connected to one end of said metering valve means opposite said metering valve, said diaphragm forming with a first portion of said housing a pressure chamber open to the atmosphere on one side of said diaphragm and on its other side a metering vacuum chamber, said actuator means further including a spring means positioned in said metering vacuum chamber to be in operative abutment against said diaphragm to normally bias said metering valve toward said first position, fluid passage means in said housing in communication at one end with said metering vacuum chamber and at its other end opening to the atmosphere, a timing valve means operatively positioned in said housing for movement to control fluid flow through said passage means, said timing valve means including a second actuator means having a second diaphragm with a timing valve means therein forming with a second portion of said housing a vacuum chamber on one side of said second diaphragm and a timing chamber on the opposite side of said second diaphragm, said timing chamber being in fluid communication with said vacuum chamber as controlled by said timing valve means, port means in said housing opening at one end into said vacuum chamber and at its other end being connectable to the engine induction system downstream of the throttle, said timing valve means including a valve and a valve stem, a valve stem guide bore means in said housing opening into said vacuum chamber, said valve stem being guided in said valve stem guide bore means to form therewith a metering control orifice passage means, said fluid passage means including a passage portion in fluid communication with said metering control orifice downstream of said valve in terms of flow from the atmosphere to said metering vacuum chamber through said fluid passage means and, said timing valve means including second spring means normally biasing said second diaphragm in a direction to effect movement of said valve in a direction blocking flow of atmospheric air through said fluid passage means to said metering vacuum chamber.

* * * * *